US005860718A

United States Patent [19]

Brüstle

[11] Patent Number: 5,860,718

[45] Date of Patent: Jan. 19, 1999

[54] DEVICE FOR ATTACHING THE FRONT PANEL OF A DRAWER TO THE SIDE WALLS OF A DRAWER

[75] Inventor: Klaus Brüstle, Höchst, Austria

[73] Assignee: Julius Blum Gesellschaft m.b.H., Höchst, Austria

[21] Appl. No.: 913,600

[22] PCT Filed: Mar. 14, 1996

[86] PCT No.: PCT/AT96/00047

§ 371 Date: Sep. 18, 1997

§ 102(e) Date: Sep. 18, 1997

[87] PCT Pub. No.: WO96/28995

PCT Pub. Date: Sep. 26, 1996

[30] Foreign Application Priority Data

Mar. 20, 1995 [AT] Austria ..... 487/95

[51] Int. Cl.[6] ..... A47B 88/00

[52] U.S. Cl. ..... 312/348.2; 312/348.4; 312/330.1

[58] Field of Search ..... 312/348.2, 348.4, 312/348.1, 330.1, 265.5, 265.6, 257.1, 263

[56] References Cited

U.S. PATENT DOCUMENTS 4,846,538 7/1989 Rock et al. ..... 312/330.1 X
4,850,659 7/1989 Rock et al. ..... 312/330.1 X
5,163,774 11/1992 Lautenschlager ..... 312/330.1 X
5,281,022 1/1994 Rock ..... 312/348.4

FOREIGN PATENT DOCUMENTS 581325 2/1994 European Pat. Off. ..... 312/348.4

*Primary Examiner*—Peter M. Cuomo
*Assistant Examiner*—Hanh V. Tran
*Attorney, Agent, or Firm*—Wenderoth, Lind & Ponack, L.L.P.

[57] ABSTRACT

The front panel of a drawer is attached to a side wall of the drawer by a device including a support part secured to the side wall and a holding part secured to the front panel, the support part and holding part being coupled together. A rocker element has a shank that mounts the rocker element to the support part. A spring acts on a stop on the shank to bias the rocker element in a direction to be toward a rear of the drawer side wall. The rocker element thus is moved to a coupling position coupling the holding part to the support part. The support part is capable of limited movement toward the rear of the side wall relative to the holding part against a biasing force of the spring.

32 Claims, 6 Drawing Sheets

DEVICE FOR ATTACHING THE FRONT PANEL OF A DRAWER TO THE SIDE WALLS OF A DRAWER

BACKGROUND OF THE INVENTION

The invention relates to a device for attaching the front panel of a drawer to side walls of a drawer. The device includes a holding part secured to the front panel and a support part secured to a drawer side wall on each side of the drawer, whereby the holding parts can be coupled with the supporting parts. A spring, preferably a helical spring, acts in the longitudinal direction of the drawer side wall between the support part and the holding part in such a way, that when the front panel is mounted, limited relative movement of the holding part with respect to the support part against the action of the spring is possible. A rocker element is mounted in the support part and engages the holding part.

Such a device is known, for example from EU-A1 0 636 327. Such a device provides, in addition to rapid fastening of the front panel to the drawer side walls, a shock absorbing resilience for the front panel when the drawer is pushed into the furniture carcass too rigorously and the front panel strikes the side walls of the carcass. In this way not only are rough jolts avoided, but also the hold of the dowels by which the holding parts of the device are held on the front panel is improved.

SUMMARY OF THE INVENTION

It is the object of the invention to improve such a device and especially to reduce the effort and complexity of construction of a known such device.

The object of the invention is achieved in that the rocker element is mounted on the support part without an axle and that the rocker element includes a shank by which it is anchored on the support part, whereby the spring which struts the support part pushes or pulls the rocker element in the direction to the rear end (that is the end which is turned away from the front panel) of the drawer side wall. A good and simple attachment of the spring is achieved in that the spring is a pressure spring and a helical spring which is mounted on the shank and which presses on stops arranged at the sides of the shank. An inexpensive embodiment provides that the shank and rocker element is punched out of sheet iron and that the shank projects through a slot in a web of the support part.

To ensure secure locking and unlocking of the holding part in the support parts it is advantageously provided that the rocker element is provided with two hooks, one of which detains the holding part pushed into the support part the other of which is constructed as a stop for the holding part in the region of the support part, whereby the hook formed as a stop is provided with an oblique edge to abut the holding part.

The support part is provided with two horizontal webs between which the holding part is insertable. To improve the stability of the holding part in the support part there is advantageously provided that the hook which is formed as a stop projects into a slot in one of the horizontal guide webs of the support part when the holding part is released. The other horizontal web is provided with a slot open towards the rear and into which projects the rocker member, the borders of such slot providing a lateral guide for the rocker element.

To enable unlocking of the front panel, that is the holding parts from the support parts, it is advantageously provided in an embodiment of the invention that the rocker member is provided with a hole for the insertion of a screw driver for cross-slotted screws or the like, and that a rack profile is provided in the support part and is aligned perpendicularly to the front panel. The screw driver which is inserted into the hole of the rocker member meshes with the rack profile. The rack profile constitutes the edge of a slot the width of which corresponding approximately to the diameter of the hole in the rocker element. To provide that the rocker element is pushed slightly upwardly when unlocked, the rack profile has a curved portion at its end directed to the front panel.

To limit movement on the spring pressure of the holding part and therefore the front panel, the rocker element has a stop directed towards the front panel which stop abuts the support part when a pulling force acts on the front panel held by the rocker element.

BRIEF DESCRIPTION OF THE DRAWINGS

In the following an embodiment of the invention is described with reference to the attached drawings, wherein.

DETAILED DESCRIPTION OF THE INVENTION

Figures 1, 1A:
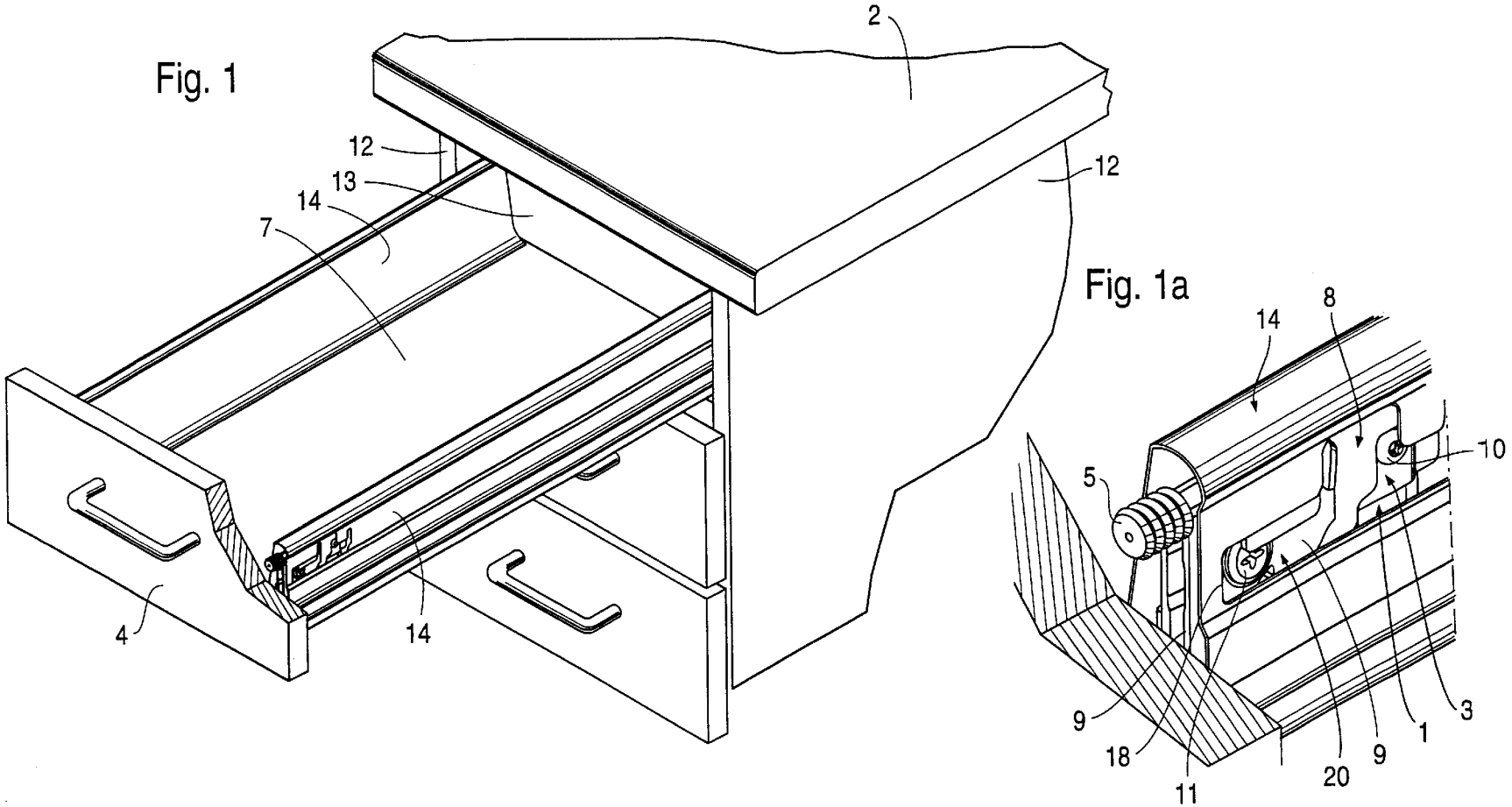
FIG. 1 is a schematic perspective view of a furniture carcass or body with a drawer, a front panel of the drawer being cut away in the region of a drawer side wall.
FIG. 1*a* is an enlarged similar view of a portion thereof.

FIG. 1 shows a furniture carcass or cabinet having side walls 12 and a top panel 2, and drawers being guided in such furniture carcass. On each furniture side wall is mounted a support rail (not shown) for each drawer. A front panel 4 of each drawer is secured to side walls 14 thereof by fastening devices 20 according to the invention. Each drawer side wall 14 is provided at its front end with a cut-out 18 in an outer wall, thus enabling a tool to obtain access to the respective fastening device 20. At the inner end of the drawer a rear wall 13 is fastened to the drawer side walls 14.

A bottom plate 7 of the drawer rests on lower horizontal webs 17 of profiles 15 (FIG. 7) which are inserted into the drawer side walls 14 and/or on horizontal webs of pull-out rails connected to the drawer side walls. Between the support rail of the cabinet and the pull-out rail of the drawer is a center rail, thus forming a differential or telescopic pull-out guide assembly on each side of the drawer.

Figure 7:
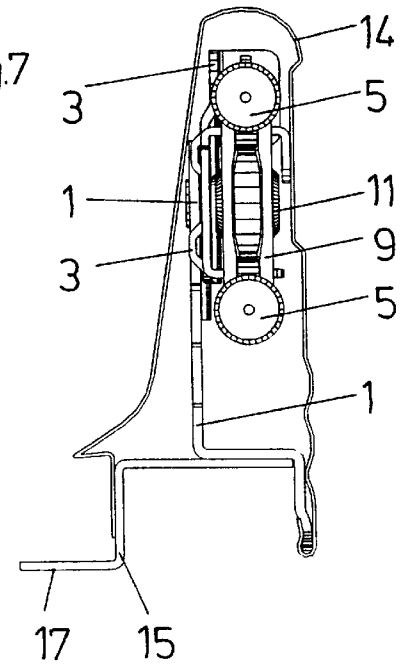
FIG. 7 is a front view of the fastening device and of a drawer side wall.
Figure 12:
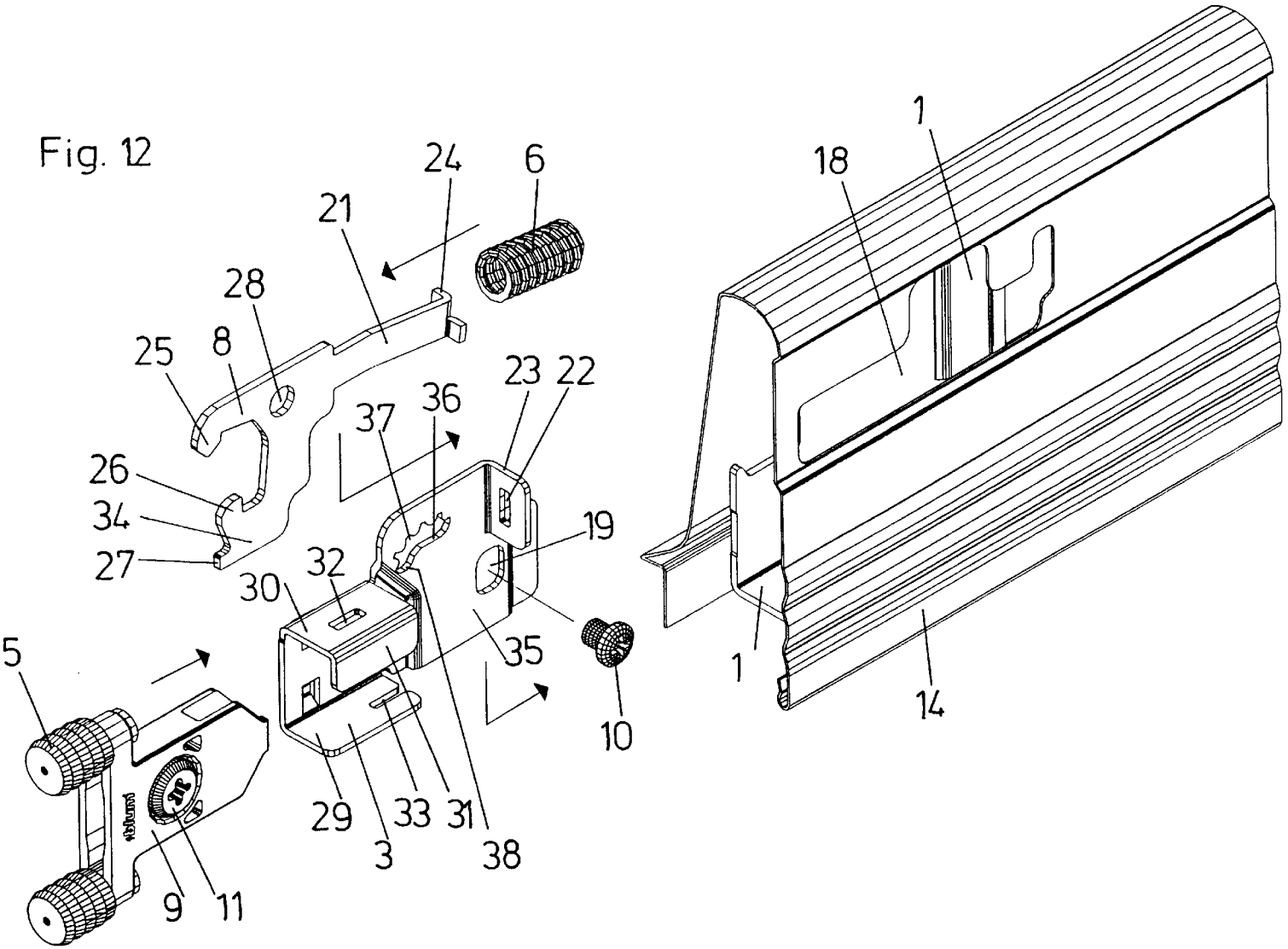
FIG. 12 is an exploded perspective view of parts of the fastening device and the drawer side wall.

The drawer side wall 14 seen especially in FIGS. 7 and 12, is constructed as a double-walled frame and covers the rails of the pull-out guide assembly and the fastening device 20 for securing the front panel 4. With respect to the function of the fastening device 20 the pull-out rail is part of the drawer side wall 14. The fastening device 20 can be fastened to the drawer side wall 14 as well as to the pull-out rail.

Figure 6:
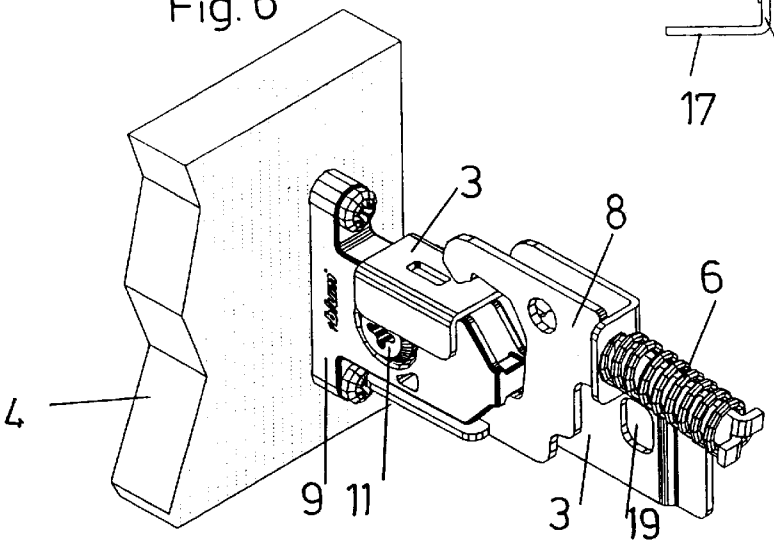
FIG. 6 is a perspective view of the parts of the fastening device with holding parts being held in support parts.
Figure 5:
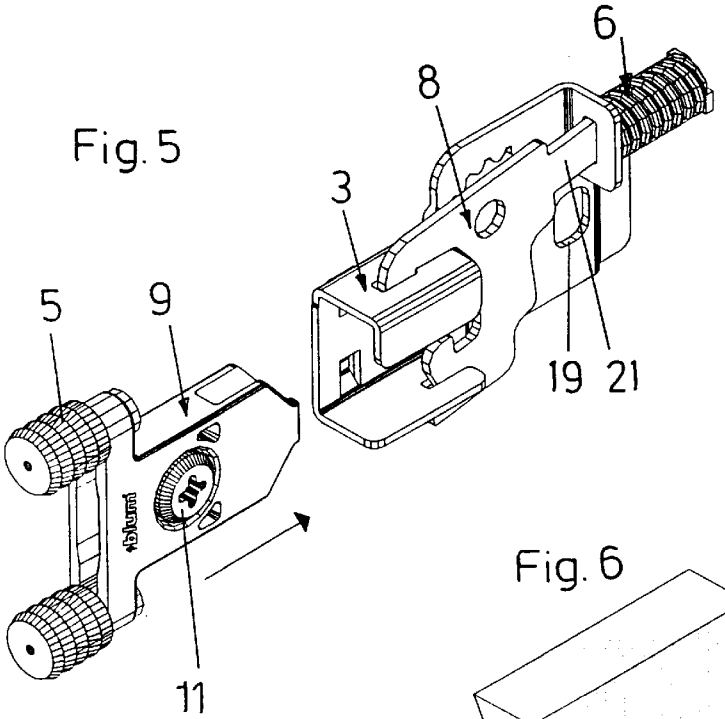
FIG. 5 is a perspective view of parts of the fastening device before suspension of the front panel.

As best seen in FIGS. 5 and 6 the fastening device 20 according to the invention comprises a holding part 9 which is fastened to the front panel 4 by means of dowels 5. At the side of the drawer is provided a support part 3 which is mounted on a base plate 1 which is directly fastened to a profile 15 inserted into the drawer side wall 14 (FIG. 7). The profile 15 can be a profile which extends over the entire length of the drawer side wall 14 or it can consist of a plurality of profile parts positioned in the longitudinal direction of the drawer side wall and spaced from each other. The pull-out rails fastened to the drawer are fastened to the profiles 15, preferably hooked thereto.

The support part 3 is secured in a vertically adjustable manner to the base plate 1 by means of a clamping screw 10 (FIG. 1) which protrudes through a hole 19 in the support part 3. In the illustrated embodiment the hole 19 is quadrangular. Its size is such that movement of the support part 3 with respect to the clamping screw 10 is possible before the support part 3 is clamped. An adjustment screw 11 for lateral adjustment of the front panel 4 is mounted in the holding part 9.

A rocker element 8 which is preferably punched out of sheet steel is mounted in the support part 3. The rocker element 8 is provided with a shank 21 which protrudes through a slot 22 in a flap 23 of the support part 3. A spring 6, which is a pressure spring and a helical spring, is mounted on the shank 21, the spring abutting the support part 3, for example the flap 23, on one side and the rocker element 8, for example on lateral stops 24 of the shank 21, on the other side. The front end of rocker element 8 is provided with two hooks 25, 26 directed towards each other and a lower stop 27. Further, the rocker element 8 is provided with a hole 28 which permits insertion of a screw driver 16 (FIGS. 9–10*a*).

Figure 8:
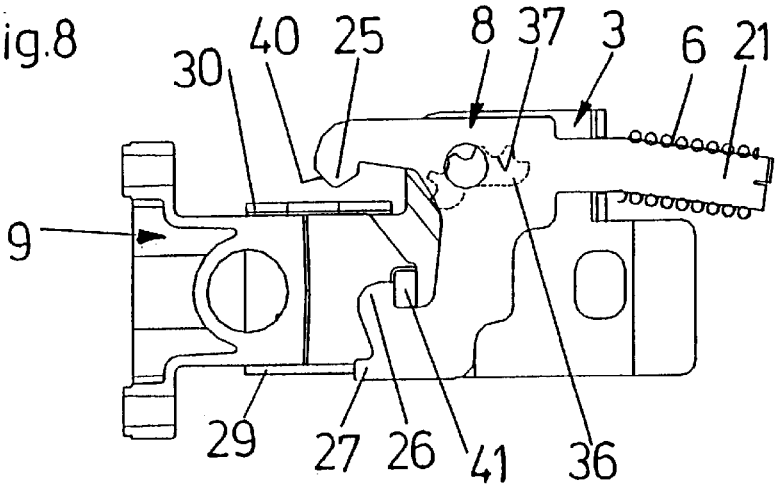
FIG. 8 is a side view of the fastening device with the front panel being suspended.
Figure 9:
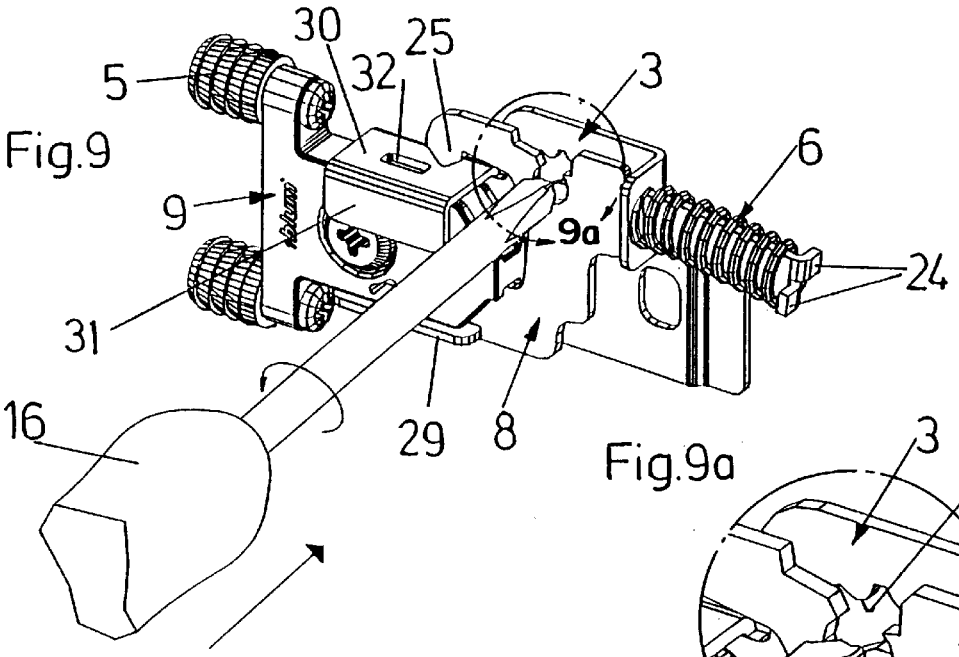
FIG. 9 is a perspective view of the fastening device.
Figure 9A:
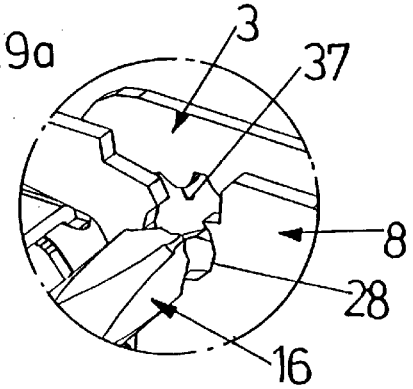
FIG. 9*a* is an enlarged view and shows schematically rotation of a rocker member for unlocking the holding part from the support part.
Figure 10:
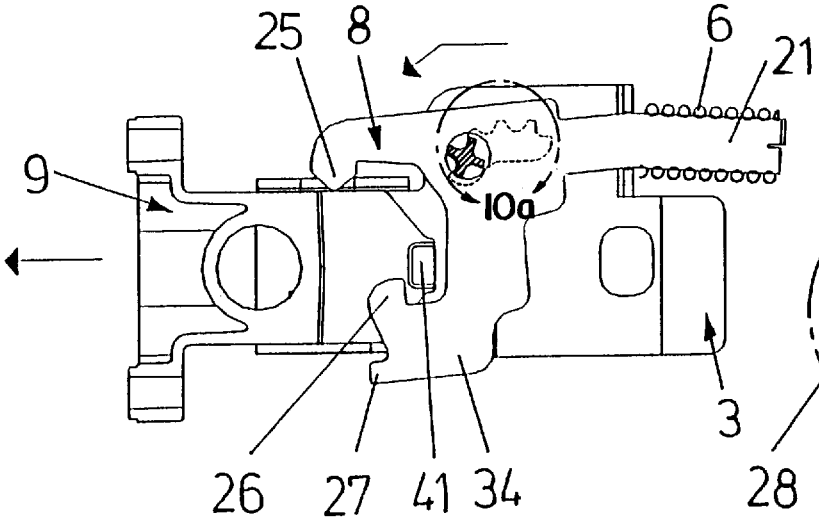
FIG. 10 is a side view of the fastening device.
Figure 10A:
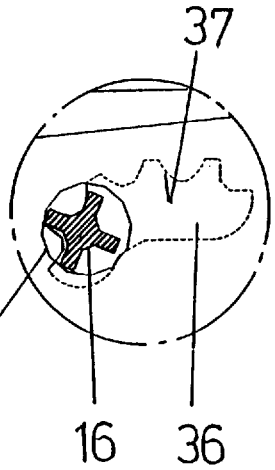
FIG. 10*a* is an enlarged view and shows schematically rotation of rocker member during unlocking.
Figure 11:
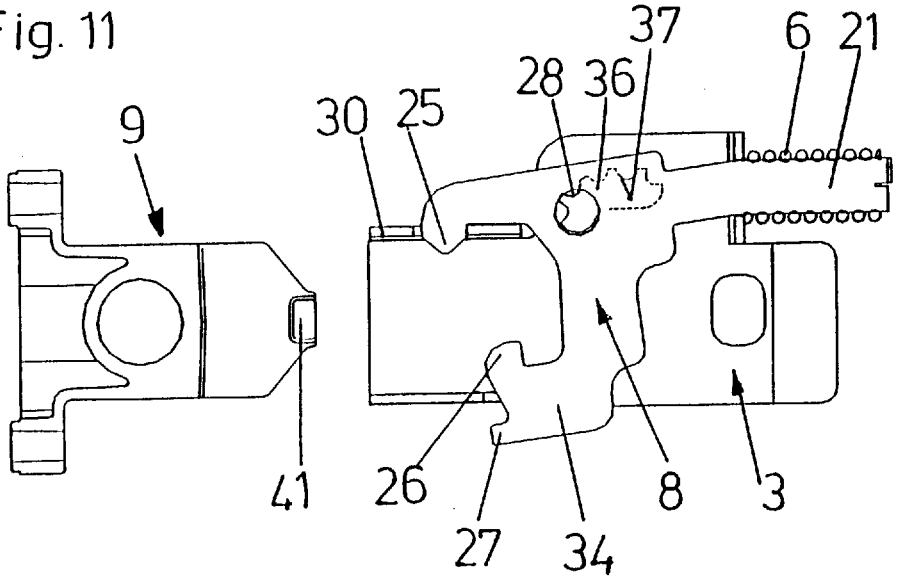
FIG. 11 is a side view similar to FIG. 10, but showing the holding part being fully unlocked.

The support part 3, as can be seen especially in FIGS. 8, 9 and 12, is provided at its front with a case-like area including an upper horizontal web 30, a lower horizontal web 29 and a vertical border web 31 extending at an angle from the upper horizontal web 30. The upper horizontal web 30 is provided with a slot 32 into which, as can be seen in FIG. 5, the hook 25 of the rocker element 8 protrudes when the holding part 9 is released from the support part 3. The lower horizontal web 29 is provided with a slot 33 opened to the rear and into which protrudes lower arm 34 of rocker element 8 on which the hook 26 and the stop 27 are formed. Further, mounting plate 35 of support part 3 is provided with a slot 36 which is bordered at its upper rim by a rack profile 37. The front end of rack profile 37 and slot 36 are provided with a curved portion 38.

Figure 2:
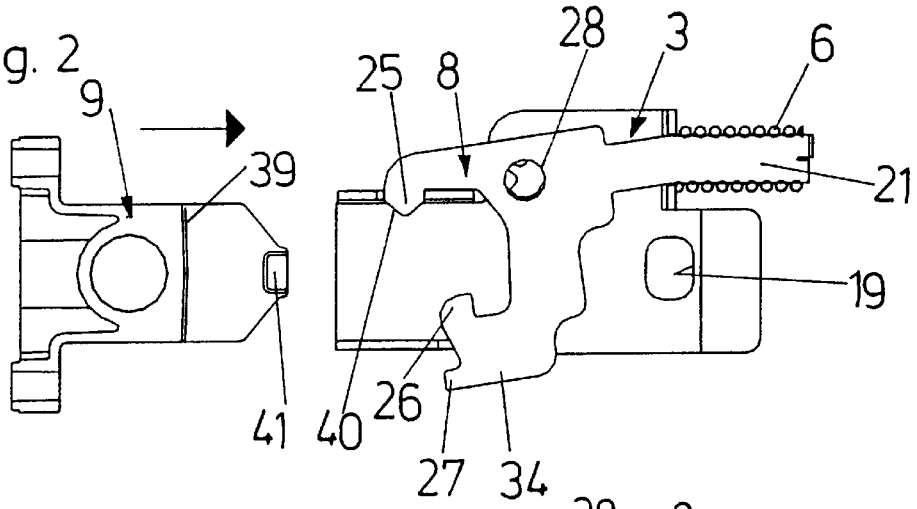
FIGS. 2 to 4 are side views of a fastening device according to the invention in various stages of attachment of the front panel.
Figure 3:
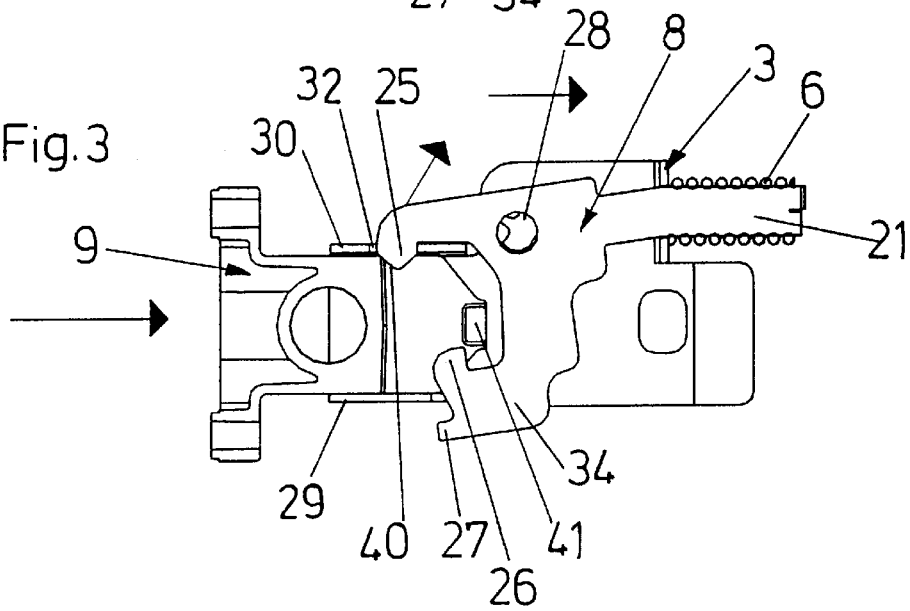
Figure 4:
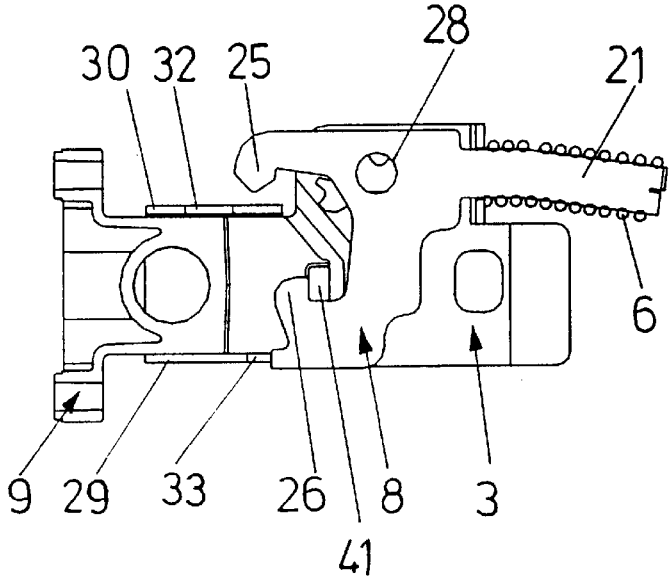

Before mounting the front panel 4 on the drawer side walls 14, the holding parts 9 are fastened to the front panel 4 by means of dowels 5, and the supporting parts 3 with the rocker elements 8 are screwed to the base plates 1 by screws 10 and therefore fastened within the drawer side walls 14. At this stage the rocker member 8 is in the position shown in FIG. 2. If the holding member 9 is pushed into the case-like area of the support part 3 in the direction of the arrows of FIGS. 2 and 3, whereby it is guided between the horizontal webs 29, 30, an edge 39 of member 9 abuts with an inclined edge 40 of the hook 25 and pushes the rocker member 8 in the direction shown by the arrows of FIG. 3, i.e. the rocker member 8 is moved upwardly and clockwise. Because of this, the lower hook 26 of the rocker member 8 engages behind a web 41 of the holding part 9 and the holding part 9 is secured in the support part 3 as shown in FIG. 4. The rocker member 8 and consequently the holding part 9 with the front panel 4 are now pulled to the rear by the spring 6, and therefore the front panel 4 is pressed onto the front ends of the drawer side walls 14.

If the drawer is pushed into the furniture carcass with excessive vigor and the front panel 4 abuts against the front end edges of the furniture side walls 12, the support part 3 together with the drawer side wall 14 can move a small distance away from the holding part 9 so that the drawer is, so to say, detached from the front panel and moves further into the furniture carcass. Once the push-in energy is expended, the drawer side walls 14 are pushed against the front panel 4 by the springs 6. In order that the front panel 4 does not stress the spring 6 excessively when the drawer is pulled out, stop 27 provided on the rocker element 8 abuts the horizontal web 29 of the support part at the end of the slot 33 when the rocker element 8 reaches its front-most position.

If the front panel 4 is to be detached from the drawer side walls, a screw driver 16 is inserted into the hole 28 of the rocker element 8 as shown in FIGS. 9 and 10, so that the front end of the screw driver 16 meshes with the rack profile 37 in the support part 3. If the screw driver 16 is rotated counter-clockwise the rocker element 8 is tilted whereby its hook 25 engages in the slot 32 of the upper horizontal web 30 of the support part and the hook 26 is pushed downwardly away from the web 41 of the holding part 9. The holding part 9 thus is released and can now be pulled from the support part 3.

For optimal utilization of the strength of the spring 6, the shaft 21 is bent, advantageously providing a knee so that the free end of the shaft 21 with the stops 24 is directed slightly downwardly as shown in FIG. 8 when the holding part is engaged.

Stability of the fastening device 20 is improved by the rocker member 8 being held in the slot 33 and in the realized position with its hook 25 in the slot 32 of the support part 3.

I claim:

1. A device for attaching a front panel of a drawer to a side wall of the drawer, said device comprising:

a support part to be secured to the side wall;

a holding part to be secured to the front panel;

a rocker element having a shank mounting said rocker element on said support part, said shank having a stop;

a spring acting on said stop to bias said rocker element in a direction to be toward a rear of the side wall to a coupling position coupling said holding part to said support part; and said support part being capable of limited movement in said direction relative to said holding part against a biasing force of said spring.

2. A device as claimed in claim 1, wherein said stop is on a free end of said shank.

3. A device as claimed in claim 1, wherein said spring acts between said stop and a web of said support part.

4. A device as claimed in claim 1, wherein said spring comprises a helical pressure spring mounted on said shank.

5. A device as claimed in claim 1, wherein said rocker element including said shank is stamped from sheet steel.

6. A device as claimed in claim 1, wherein said shank extends through a slot in a web of said support part.

7. A device as claimed in claim 1, wherein said rocker element includes a first hook operable, when said rocker element is in said coupling position, to retain said holding part and a second hook operable as a stop to be abutted by said holding part.

8. A device as claimed in claim 7, wherein said second hook projects into a slot in a horizontal guide web of said support part when said holding part is released from said support part.

9. A device as claimed in claim 7, wherein said second hook has an inclined edge to be abutted by said holding part.

10. A device as claimed in claim 7, wherein said first and second hooks are directed toward each other.

11. A device as claimed in claim 1, wherein said support part has a rack extending in a direction to be perpendicular to the front panel, and said rocker element has therein a hole through which may be inserted a tool to mesh with said rack, thereby to enable movement from said coupling position of said rocker element relative to said support part.

12. A device as claimed in claim 11, wherein said rack is formed on an edge of a slot formed in said support part, said slot having a width approximately equal to a diameter of said hole in said rocker element.

13. A device as claimed in claim 11, wherein said rack has a curve at an end directed toward said holding part.

14. A device as claimed in claim 1, wherein said rocker element includes a stop directed toward said holding part and operable to abut said support part upon movement of said holding part in a direction away from said support part.

15. A device as claimed in claim 1, wherein said support part includes two horizontal webs between which said holding part is insertable, one said web having therein a slot that is open at an end directed away from said holding part, said rocker element extending into said slot, and edges of said one web defining said slot forming a lateral guide for said rocker element.

16. A device as claimed in claim 1, wherein said shank has therein a bend.

17. A drawer including side walls, a front panel and devices attaching said front panel to respective said side walls, each said device comprising:

a support part secured to said respective side wall;

a holding part secured to said front panel;

a rocker element having a shank mounting said rocker element on said support part, said shank having a stop;

a spring acting on said stop to bias said rocker element in a direction toward a rear of said side wall to a coupling position coupling said holding part to said support part; and said support part being capable of limited movement in said direction relative to said holding part against a biasing force of said spring.

18. A drawer as claimed in claim 17, wherein said stop is on a free end of said shank.

19. A drawer as claimed in claim 17, wherein said spring acts between said stop and a web of said support part.

20. A drawer as claimed in claim 17, wherein said spring comprises a helical pressure spring mounted on said shank.

21. A drawer as claimed in claim 17, wherein said rocker element including said shank is stamped from sheet steel.

22. A drawer as claimed in claim 17, wherein said shank extends through a slot in a web of said support part.

23. A drawer as claimed in claim 17, wherein said rocker element includes a first hook operable, when said rocker element is in said coupling position, to retain said holding part and a second hook operable as a stop to be abutted by said holding part.

24. A drawer as claimed in claim 23, wherein said second hook projects into a slot in a horizontal guide web of said support part when said holding part is released from said support part.

25. A drawer as claimed in claim 23, wherein said second hook has an inclined edge to be abutted by said holding part.

26. A drawer as claimed in claim 23, wherein said first and second hooks are directed toward each other.

27. A drawer as claimed in claim 17, wherein said support part has a rack extending in a direction perpendicular to said front panel, and said rocker element has therein a hole through which may be inserted a tool to mesh with said rack, thereby to enable movement from said coupling position of said rocker element relative to said support part.

28. A drawer as claimed in claim 27, wherein said rack is formed on an edge of a slot formed in said support part, said slot having a width approximately equal to a diameter of said hole in said rocker element.

29. A drawer as claimed in claim 27, wherein said rack has a curve at an end directed toward said front panel.

30. A drawer as claimed in claim 17, wherein said rocker element includes a stop directed toward said front panel and operable to abut said support part upon movement of said holding part in a direction away from said support part.

31. A drawer as claimed in claim 17, wherein said support part includes two horizontal webs between which said holding part is inserted, one said web having therein a slot that is open at an end directed away from said front panel, said rocker element extending into said slot, and edges of said one web defining said slot forming a lateral guide for said rocker element.

32. A drawer as claimed in claim 17, wherein said shank has therein a bend.

* * * * *